US011125031B2

(12) United States Patent
Larchar et al.

(10) Patent No.: US 11,125,031 B2
(45) Date of Patent: Sep. 21, 2021

(54) RECEIVING PIT AND TRENCH FOR A DRILLING FLUID DISPOSAL SYSTEM

(71) Applicant: Milestone Environmental Services, LLC., Houston, TX (US)

(72) Inventors: Jason Larchar, Spring, TX (US); Steve Bills, Houston, TX (US)

(73) Assignee: MILESTONE ENVIRONMENTAL SERVICES, LLC, Houston, TX (US)

( * ) Notice: Subject to any disclaimer, the term of this patent is extended or adjusted under 35 U.S.C. 154(b) by 0 days.

(21) Appl. No.: 16/517,381

(22) Filed: Jul. 19, 2019

(65) Prior Publication Data

US 2021/0017824 A1 Jan. 21, 2021

(51) Int. Cl.
*E21B 21/06* (2006.01)
*E21B 41/00* (2006.01)

(52) U.S. Cl.
CPC ..... *E21B 21/066* (2013.01); *E21B 41/0057* (2013.01)

(58) Field of Classification Search
CPC .. E21B 21/066; E21B 41/0057; E21B 21/065; E21B 21/062; E21B 21/262; E21B 21/06; E21B 49/00; E21B 49/006; C09K 8/24; B01D 21/262; B01D 21/02; G05B 15/02
See application file for complete search history.

(56) References Cited

U.S. PATENT DOCUMENTS 1,434,386 A * 11/1922 Hilleke ..... B03B 5/66 209/464
2,013,105 A * 9/1935 Mackillican ..... B01D 21/2461 209/155
2,756,965 A * 7/1956 Howe ..... E21B 21/063 175/66
2,786,651 A * 3/1957 Mickle ..... E21B 21/065 175/206
3,550,791 A * 12/1970 Furlong ..... F23G 5/444 414/304
3,731,802 A * 5/1973 James ..... B01D 17/0211 210/774
4,350,596 A * 9/1982 Kennedy, Jr. ..... B01D 17/047 210/708
4,378,290 A * 3/1983 Kennedy, Jr. ..... B04C 9/00 210/103

(Continued)

*Primary Examiner* — Claire A Norris
*Assistant Examiner* — Ekandra S. Miller-Cruz
(74) *Attorney, Agent, or Firm* — MH2 Technology Law Group LLP

(57) ABSTRACT

A drilling fluid waste disposal system includes a trench having an outlet, a receiving pit in fluid communication with the outlet of the trench, a first weir in the receiving pit, and a second weir in the receiving pit. The outlet of the trench feeds a slurry to the receiving pit, such that the slurry is at least partially separated into a liquid-enriched portion and a fluid-enriched portion using the first and second weirs. The system also includes a pump configured to draw the liquid-enriched portion of the slurry from the receiving pit and configured to introduce the at least some of the liquid-enriched portion of the slurry back into the trench. The system further includes a drying apparatus in communication with the receiving pit configured to receive the solids-enriched portion of the slurry from a second position in the receiving pit.

26 Claims, 7 Drawing Sheets

(56) References Cited

U.S. PATENT DOCUMENTS

| | | | | | |
|---|---|---|---|---|---|
| 4,389,314 | A * | 6/1983 | Petretti | B01D 21/0012 | 210/241 |
| 4,543,237 | A * | 9/1985 | Webb, Jr. | B01J 19/0006 | 250/357.1 |
| 5,458,700 | A * | 10/1995 | Masumoto | C22C 21/00 | 148/403 |
| 5,570,749 | A * | 11/1996 | Reed | E21B 21/066 | 175/206 |
| 5,571,408 | A * | 11/1996 | Rising | B01D 29/27 | 210/167.29 |
| 6,471,456 | B2 * | 10/2002 | Wassick | B08B 17/00 | 410/4 |
| 7,276,154 | B1 * | 10/2007 | Schaefer | B01D 21/0003 | 210/104 |
| 7,568,535 | B2 * | 8/2009 | Larson | E21B 21/063 | 175/66 |
| 8,459,443 | B2 * | 6/2013 | Smith | B65G 11/126 | 198/550.1 |
| 2002/0134550 | A1 * | 9/2002 | Leeson | E21B 21/066 | 166/266 |
| 2004/0012816 | A1 * | 1/2004 | Minowa | H04N 1/465 | 358/2.1 |
| 2006/0124525 | A1 * | 6/2006 | Bellafiore | B01D 15/22 | 210/198.2 |
| 2008/0128173 | A1 * | 6/2008 | Hollier | E21B 21/065 | 175/212 |
| 2015/0129312 | A1 * | 5/2015 | Bender | E21B 21/01 | 175/66 |
| 2015/0284811 | A1 * | 10/2015 | Knight | E21B 43/00 | 506/2 |
| 2017/0009557 | A1 * | 1/2017 | Harman | E21B 41/0057 | |

* cited by examiner

RECEIVING PIT AND TRENCH FOR A DRILLING FLUID DISPOSAL SYSTEM

BACKGROUND

When drilling a wellbore in a subterranean formation, a fluid is pumped down into the wellbore to cool the drill bit and to circulate cuttings from the subterranean formation back to the surface. This fluid with cuttings is referred to as a drilling fluid waste. The drilling fluid waste may present environmental liabilities and may be expensive to dispose of at the surface. As a result, it may be desirable to dispose of the drilling fluid waste by pumping at least a portion of the drilling fluid waste back into the subterranean formation. However, particles in the drilling fluid waste may fall out of the drilling fluid waste if the density and/or viscosity of the drilling fluid waste is not within a predetermined range. This may limit the amount of drilling waste fluid that may be pumped back into the subterranean formation.

Furthermore, the process of receiving the drilling fluid waste, which may be received in the form of solids, in a disposal facility may be time-consuming and inconvenient. Generally, the solids may be received by backing up a truck into a receiving area and dumping the truck. The trucks may then be washed out with water. However, the solids may be prone to fouling equipment, and the process may use a large amount of water.

SUMMARY

Embodiments of the disclosure may provide a drilling fluid waste disposal system that includes a trench having an outlet, a receiving pit in fluid communication with the outlet of the trench, a first weir positioned in the receiving pit, and a second weir positioned in the receiving pit. The outlet of the trench is configured to feed a slurry comprising a solid and a liquid to the receiving pit such that the slurry is separated into a liquid-enriched portion and a solid-enriched portion at least partially by the first and second weirs. The system further includes a pump in communication with the receiving pit and the trench. The pump is configured to draw the liquid-enriched portion of the slurry from a first position in the receiving pit, the second weir being between the first position and the outlet of the trench, and the pump is configured to introduce the at least some of the liquid-enriched portion of the slurry back into the trench. The system also includes a drying apparatus in communication with the receiving pit. The drying apparatus is configured to receive the solids-enriched portion of the slurry from a second position in the receiving pit. The first weir is between the second position and the outlet of the trench.

Embodiments of the disclosure may also provide a method for drilling fluid waste disposal. The method includes receiving solids through a grate into a trench, pumping a liquid-enriched portion of a slurry into the trench to carry the solids in a slurry in the trench and through a trench outlet, the liquid-enriched portion being pumped by a pump in fluid communication with a receiving pit at a first position of the receiving pit, receiving the slurry from the trench outlet into the receiving pit, receiving a solids-enriched portion of the slurry past the first weir into a drying apparatus, and receiving at least some of the liquid-enriched portion of the slurry past the second weir, wherein the pump draws the at least some of the liquid-enriched portion that is received past the second weir.

Embodiments of the disclosure may further provide a drilling fluid disposal system including a trench comprising a main portion having an outlet. A cross-section of the main portion has vertical sidewalls, angled sidewalls each extending at an obtuse angle from a respective one of the vertical sidewalls, and a rounded bottom connecting the angled sidewalls. The system further includes a receiving pit in fluid communication with the outlet of the trench, a first weir positioned in the receiving pit, and a second weir positioned in the receiving pit. The outlet of the trench is configured to feed a slurry comprising a solid portion and a liquid portion into the receiving pit between the first and second weirs. The system further includes a first pump in communication with the receiving pit and the trench. The first pump is configured to draw at least some of the liquid portion of the slurry from a first position in the receiving pit, the second weir being between the first position and the outlet of the trench, and the first pump is configured to introduce the at least some of the liquid portion of the slurry back into the trench. The system also includes a drying apparatus in communication with the receiving pit. The drying apparatus is configured to receive at least some of the solids portion of the slurry from a second position in the receiving pit. The first weir is between the second position and the outlet of the trench. Further, the system includes a second pump in communication with the receiving pit and an injection well. The second pump is configured to draw at least some of the liquid portion of the slurry from the receiving pit, and the at least some of the liquid portion of the slurry that is drawn by the second pump is injected into an injection well.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
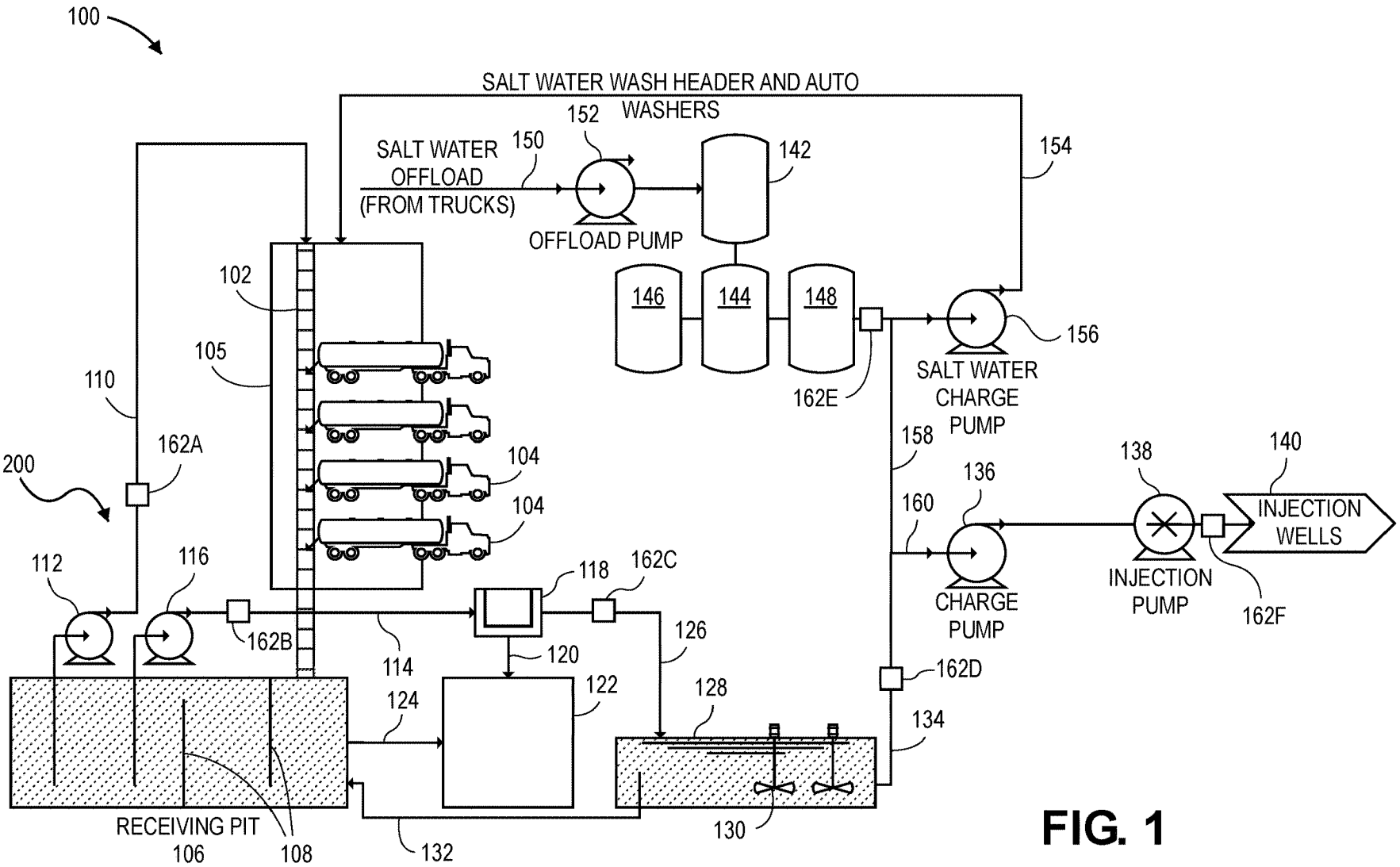
FIG. 1 illustrates a schematic view of a fluid disposal injection system, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. The embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Finally, unless otherwise provided herein, "or" statements are intended to be non-exclusive; for example, the statement "A or B" should be considered to mean "A, B, or both A and B."

FIG. 1 illustrates a schematic view of a drilling fluid waste disposal system 100, according to an embodiment. The system 100 may be used to treat and subsequently inject a drilling fluid waste into a disposal well in a subterranean formation. As will be described in greater detail below, the system 100 may include a receiving pit system 200, including a trench 102 configured to receive a drilling fluid waste from a wellbore. The drilling fluid waste may include cuttings (e.g., clay), water, hydrocarbons, chemicals introduced into the wellbore, or a combination thereof. As will be described in greater detail below, the trench 102 may include a grate or other screening device that may be configured to allow one or more vehicles (e.g., trucks) 104 to drive over the trench 102, enabling a pull-through arrangement in the receiving area 105, rather than a back-in. Thus, as shown, the drilling fluid waste may be transported from the wellbore to the trench 102 via the one or more trucks 104. In another embodiment, the drilling fluid waste may be transported from the wellbore to the trench 102 via a pipeline.

The receiving pit system 200 may also include a receiving pit 106 to receive the drilling fluid waste from the trench 102. The receiving pit 106 may include one or more weirs 108 that form a tortuous path through the receiving pit 106, which may serve to allow the solids portion of the drilling fluid waste to settle and separate at least partially from suspension within the liquids portion thereof. As will be described in greater detail below, a liquids-enriched portion of the drilling fluid waste in the receiving pit 106 may be transferred (e.g., through line 110 via pump 112) back to the trench 102 where the drilling fluid waste may be used to create a slurry in the trench 102 to help the solids flow into the receiving pit 106 rather than accumulate in the trench 102. Another, solids-enriched portion of the drilling fluid waste (e.g., with a higher solids content than the slurry in the trench 102) in the receiving pit 106 may be transferred (e.g., through line 114 via pump 116) to a shaker 118.

The shaker 118 may be or include a shale shaker, a centrifuge, a filter, a strainer basket, a sieve, or the like. The shaker 118 may filter/separate solids (e.g., particles) from the drilling fluid waste, thereby producing a removed set of solids (e.g., particles) and a filtered drilling fluid waste. In some embodiments, the shaker 118 may be provided by or otherwise representative of several shakers 118 operating in parallel. The solids separated by the shaker 118 may have a maximum cross-sectional dimension that is greater than about 100 microns, greater than about 200 microns, greater than about 300 microns, greater than about 400 microns, greater than about 500 microns, or larger. The size of the solids to be removed may be determined by formation properties, anticipated pumping schedules, and/or injection modeling software. For example, formations of higher porosity (e.g., >20%) can tolerate solids particles upwards of 1,000 microns, while formations of lower porosity (e.g., <10%) can tolerate fine particles less than 100 microns. In one example, the size of the solids may be determined by analyzing the formation porosity from gamma-ray emitting tools from open-hole logs and coordinating the porosity of a disposal well with an appropriate classification size.

The removed set of solids output from the shaker 118 may be transferred (e.g., through line 120) to a drying apparatus, e.g., a drying slab 122. The solids may then be ground into smaller particles sizes and introduced into the receiving pit 106, the shaker 118, and/or the mixing tank 128. In another embodiment, the solids may be introduced into a centrifuge (e.g., the shaker 118) for dewatering. In yet another embodiment, the solids may be transported to a landfill.

In at least one embodiment, at least a portion of the solids in the drilling fluid waste in the receiving pit 106 may bypass the shaker 118 and be transferred (e.g., through line 124) to the drying slab 122. More particularly, the solids that settle on the bottom of the receiving pit 106 may bypass the shaker 118 and be transferred directly to the drying slab 122.

The filtered drilling fluid waste from the shaker 118 may be transferred (e.g., through line 126) to a mixing tank 128. The mixing tank 128 may also be referred to as a shaker tank. The mixing tank 128 may include one or more mixers 130 that stir/mix the filtered drilling fluid waste from the shaker 118 into a substantially homogeneous state. In at least one embodiment, one or more chemical additives may be added to the filtered drilling fluid waste in the mixing tank 128. Although a single mixing tank 128 is shown, in other embodiment, a plurality of mixing tanks may be utilized. One or more of the additional mixing tanks may not have associated shakers (e.g., such as shaker 118).

In at least one embodiment, at least a portion of the filtered drilling fluid waste may be transferred (e.g., via line 132) back into the receiving pit 106 to provide overflow protection (e.g., to prevent the mixing tank 128 from overflowing) and/or provide recirculation to clean the receiving pit 106. At least a portion of the filtered drilling fluid waste may be transferred (e.g., through line 134 via one or more pumps 136, 138) into a well 140. The pump 136 may be or include a charge pump, and the pump 138 may be or include an injection pump. The well 140 may be or include a disposal well (also referred to as an injection well).

The system 100 may also include a plurality of tanks (four are shown: 142, 144, 146, 148). Water may be introduced into the first tank 142 (e.g., through line 150 via an offload pump 152). The water may be introduced from one or more of the trucks 104. The water may be fresh water, salt water, brackish water, brine, or the like. The first tank 142 may be or include a de-sanding or buffer tank that is configured to separate solids (e.g., particles) such as sand from the water to produce a first separated water. The first separated water may be transferred into the second tank 144.

The second tank 144 may be or include a skim tank (also referred to as a gunbarrel tank) that is configured to separate oil from the first separated water to produce a second separated water. The oil may be transferred from the second tank 144 to the third tank 146, and the second separated water may be transferred from the second tank 144 to the fourth tank 148.

At least a portion of the second separated water may be transferred (e.g., through line 154 via pump 156) back to the trench 102 and/or the trucks 104. For example, the second separated water may be sprayed onto the trench 102 and/or in the trucks 104 (e.g., by one or more sprinklers, automated tank cleaners, or hoses and valves) to clean or otherwise remove buildup of the drilling fluid waste and solids. At least a portion of the second separated water may be transferred (e.g., through lines 158, 160 via pumps 136, 138) to the well 140.

The system 100 may also include one or more sensors (six are shown: 162A-F). The first sensor 162A may be configured to measure one or more properties of the drilling fluid waste flowing form the receiving pit 106 to the trench 102 in line 110. The second sensor 162B may be configured to measure one or more properties of the drilling fluid waste flowing from the receiving pit 106 to the shaker 118 in line 114. The third sensor 162C may be configured to measure one or more properties of the filtered drilling fluid waste flowing from the shaker 118 to the mixing tank 128 in line 126. The fourth sensor 162D may be configured to measure one or more properties of the filtered drilling fluid waste flowing from the mixing tank 128 to the well 140 in line 134. The fifth sensor 162E may be configured to measure one or more properties of the second separated water flowing from the fourth tank 148 to the well 140 in line 158. The sixth sensor 162F may be configured to measure one or more properties of the filtered drilling fluid waste, the second separated water, or a combination/mixture thereof flowing to the well 140 in line 160. The properties may be or include flowrate, viscosity, density, pH level, percentage of solids, size of solids, pressure, temperature, or a combination thereof. A flowrate of the filtered drilling fluid waste in line 134 and/or the second separated water in line 158 may be modified to obtain the desired ratio of the mixture for injection into the well 140. The ratio of the filtered drilling fluid waste to the second separated water may be from about 10:1 to about 5:1, about 5:1 to about 3:1, about 3:1 to about 1:1, about 1:1 to about 1:3, about 1:3 to about 1:5, or about 1:5 to about 1:10. In another embodiment, the filtered drilling fluid waste may be pumped into the well 140 before and/or after the second separated water, such that the filtered drilling fluid waste and the second separated water are not combined/mixed prior to being pumped in to the well 140.

Figure 2:
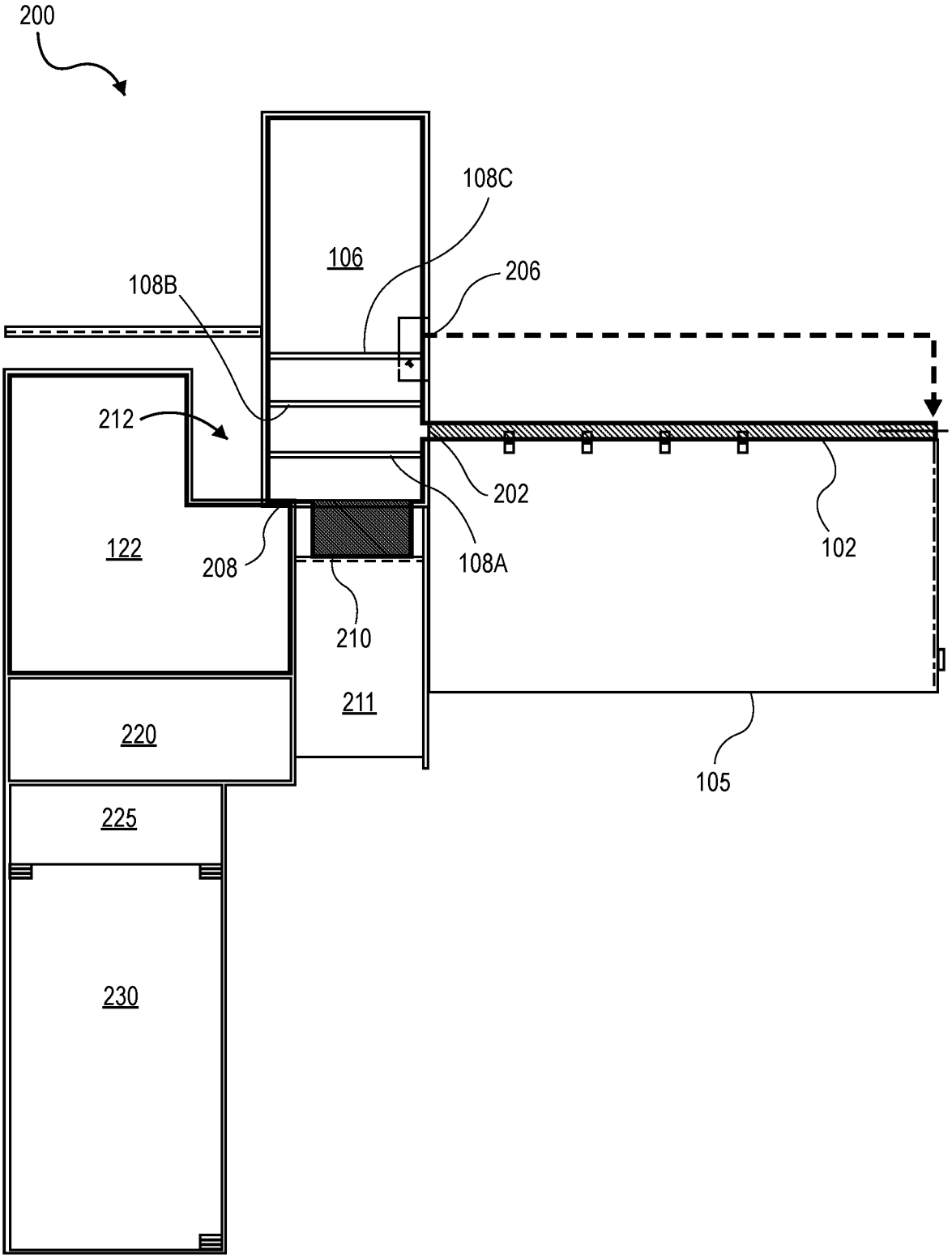
FIG. 2 illustrates a schematic view of a receiving pit system of the fluid disposal system, according to an embodiment.

FIG. 2 illustrates a schematic view of a receiving pit system 200, which may include the trench 102, the receiving pit 106, and the drying slab 122, according to an embodiment. This listing of components of the receiving pit system 200 is provided by way of example and is not meant to exclude other components of the system 100 (or other systems).

As shown, the trench 102 may extend along the receiving area 105 and may have an outlet 202 that is connected to and in fluid communication with the interior of the receiving pit 106. The receiving pit 106 may include three weirs 108, specifically, a first weir 108A, a second weir 108B, and a third weir 108C, with the second weir 108B being between the first and third weirs 108A, 108C. The outlet 202 of the trench 102 may be positioned between the first and second weirs 108A, 108B, as shown, or may be positioned adjacent to the first weir 108A, such that the first weir 108A is between the outlet 202 and the second weir 108B. As such, the receiving pit 106 may be separated in such a way to allow segregating certain fluids and holding them without flowing immediately into the rest of the system.

The pump 112 (FIG. 1) may also be in fluid communication with the receiving pit 106, e.g., at a fluid intake position 206 or any other position in the pit 106. The second and/or third weirs 108B, 108C may be between the outlet 202 of the trench 102 and the fluid intake position 206. As described above, the pump 112 may serve to remove at least some of the liquids (e.g., a liquid-enriched portion of the slurry received from the trench 102) from the receiving pit 106 and provide the pumped fluids back into the trench 102, as indicated by the dashed line, to assist in moving solids through the trench 102 and into the receiving pit 106. Another amount of the liquid-enriched portion may be pumped into the injection well 140, e.g., at least partially by the pumps 116 and 136 and via the mixing tank 128.

The drying slab 122 may be in communication with the receiving pit 106 at another position 208, e.g., via the shaker 118, as discussed above. The first weir 108A may be between the position 208 and the outlet 202 of the trench 102. Further, the drying slab 122 may be generally L-shaped, with the drying slab 122 defining a recess 212 where it is received partially around the receiving pit 106. In an embodiment, a chute 210 and a truck dump 211 may also be connected to the receiving pit 106, providing a secondary location for solids to be received into the receiving pit 106.

The system 200 may also include an equipment slab 220, a shaker slab 225, and a tank farm 230. The equipment slab 220 may provide a location for various pieces of equipment, e.g., pumps, generators, etc. The shaker 118 (FIG. 1) may be located at the shaker slab 225, and the tanks (e.g., tanks 142-148 and/or the mixing tank 128) may be positioned at the tank farm 230.

Figure 3A:
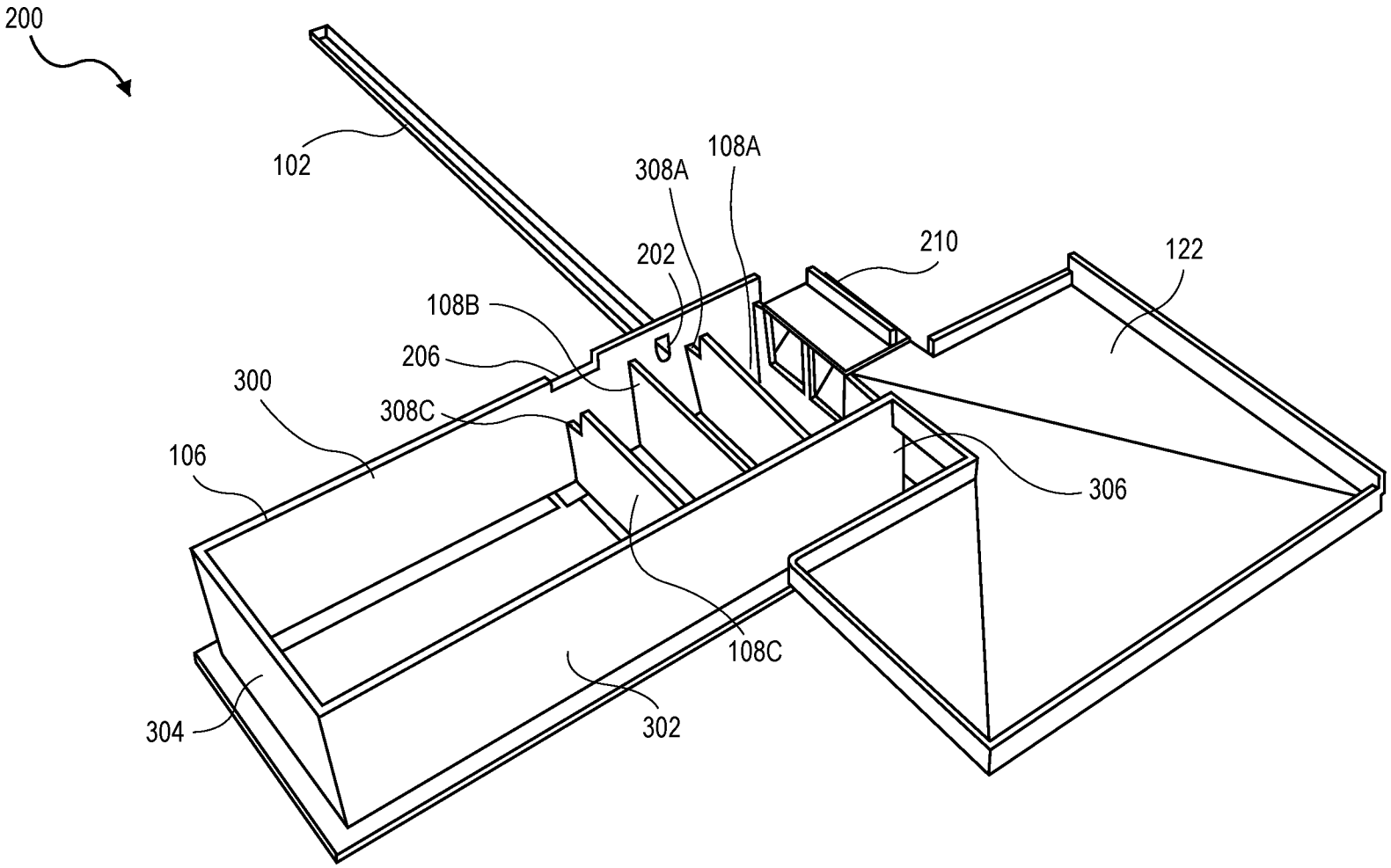
FIG. 3A illustrates a perspective view of the receiving pit system, according to an embodiment.
Figure 3B:
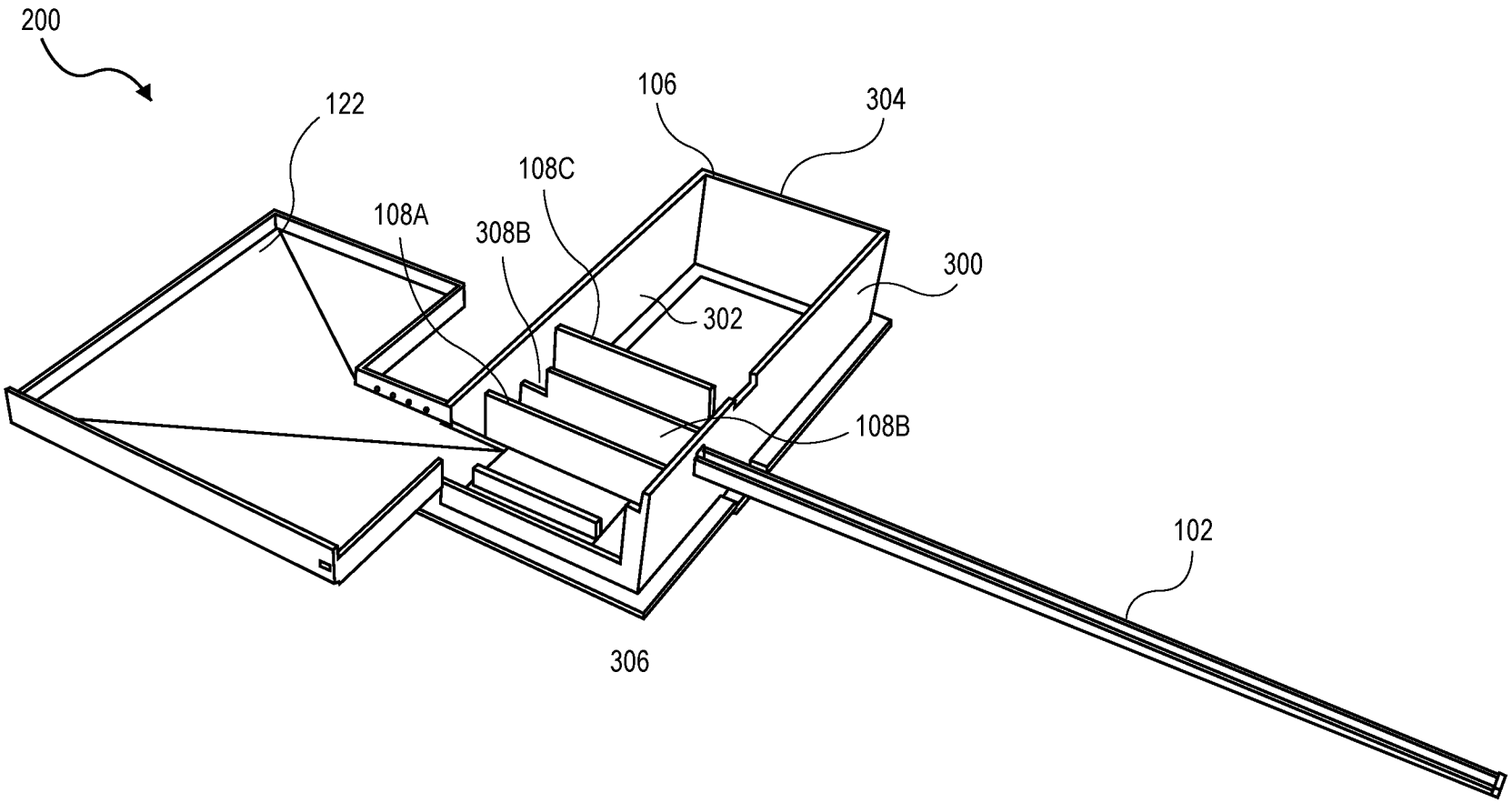
FIG. 3B illustrates another perspective view of the receiving pit system, according to an embodiment.

FIGS. 3A and 3B illustrate two perspective views of the receiving pit system 200, according to an embodiment. The receiving pit 106 has sides 300, 302, 304, 306, with sides 300 and 302 being positioned opposite to one another, and sides 304 and 306 likewise being opposite to one another. The drying slab 122 may be coupled to the side 306. The weirs 108A-C extend between the sides 300, 302. The outlet 202 of the trench 102 is formed through the side 300, between the first and second weirs 108A, 108B.

The weirs 108A-C have cutout outlets 308A-C, respectively, formed therein, e.g., at the vertical top thereof. The outlet cutouts 308A and 308C are seen in FIG. 3A, while the outlet cutout 308B of the second weir 108B is seen in FIG. 3B. The outlet cutouts 308A and 308C are formed proximal to the side 300, while the outlet cutout 308B is formed proximal to the opposite side 302. The cutout outlets 308A-C may provide a spillway where the slurry from the outlet 202 of the trench 102 moves across the weirs 108A-C. By positioning these cutout outlets 308A-C on alternating sides 300, 302, the weirs 108A-C thus provide the tortuous flowpath discussed above, which provides time and distance for at least some of the solids to settle and drop out of suspension in the slurry.

Figure 4:
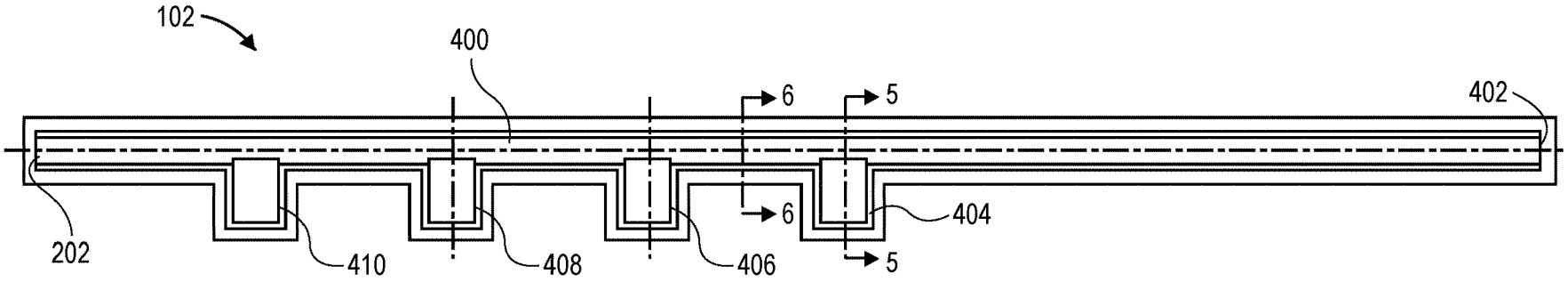
FIG. 4 illustrates a plan view of a trench for the receiving pit system, according to an embodiment.

FIG. 4 illustrates a top, plan view of the trench 102, according to an embodiment. The trench 102 has a main portion 400 that extends, in this view, horizontally, between the outlet 202 and a first end 402. The fluid pumped back from the receiving pit 106 (e.g., FIG. 2) may be fed to the trench 102 proximal to the first end 402, in order to flow through the main portion 400 and back to the outlet 202. Further, the main portion 400 may be sloped downward toward the outlet 202 from the first end 402, such that the trench 102 becomes deeper and/or at a lower elevation as proceeding to the outlet 202. The trench 102 may be sloped at any suitable slope angle, e.g., between about 0.5 degrees and about 5 degrees, between about 2 degrees and about 1.5 degrees and about 3 degrees, or between about 2 degrees and about 2.5 degrees.

The trench 102 may also include one or more loading portions (four are shown: 404, 406, 408, 410, and collectively referred to as loading portions 404-410). The loading portions 404-410 may each extend generally transverse to the main portion 400, e.g., perpendicular thereto, as shown. The loading portions 404-410 may be configured to receive solid materials therein, and channel these solid materials into the main portion 400 where the liquids coursing through the main portion 400 may carry the solids to the outlet 202.

Figure 5:
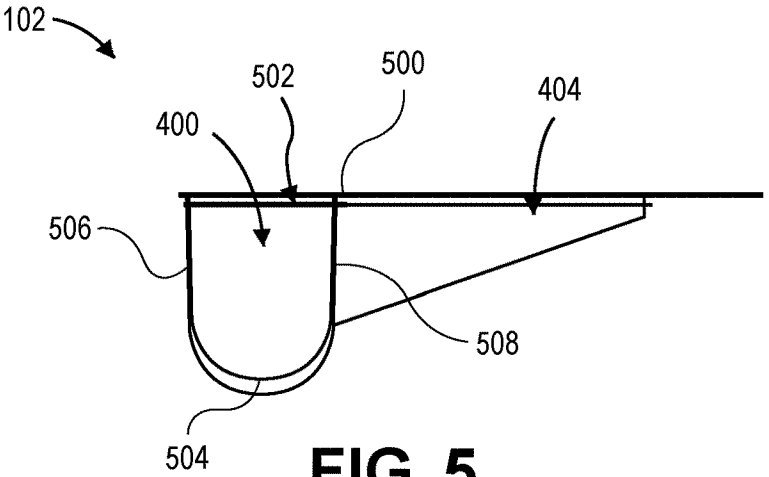
FIG. 5 illustrates a cross-sectional view of the trench, e.g., along line 5-5 in FIG. 4, according to an embodiment.

FIG. 5 illustrates a cross-sectional view of the trench 102, along line 5-5 of FIG. 4, according to an embodiment. As shown, the trench 102 may include the main portion 400 and the loading portion 404 (as an example of the loading portions 404-410, which may be generally similar in function and shape). The loading portion 404 may be sloped downward, toward the main portion 400, such that solids received into the loading portion 404 tend to fall towards the main portion 400 via gravity.

Further, a grate 500 may be positioned over an open top 502 of the trench 102, e.g., over the main portion 400 and the loading portion 404. The grate 500 may be configured to be driven over by the trucks 104 (FIG. 1) carrying the drilling fluid waste. Further, the grate 500 may include slats that are sufficiently far apart to allow the solids to fall through the grate 500 and into the trench 102. Additional details about one particular embodiment of the grate 500 are discussed below.

The main portion 400 of the trench 102 may have a rounded, e.g., ovular, or trapezoidal bottom surface 504 and substantially vertical sidewalls 506, 508. Accordingly, fluids coursing through the trench 102 may have a velocity gradient within the trench 102 that increases near the bottom surface 504 as the flowpath area decreases. This may promote carrying the solids toward the outlet 202 and avoid solids becoming entrained at the bottom surface 504. In some embodiments, the bottom surface 504 may be formed from concrete. In other embodiments, the bottom surface 504 may be formed using a liner made of a polymer, fiberglass, or another material that is inlaid into concrete.

Figure 6:
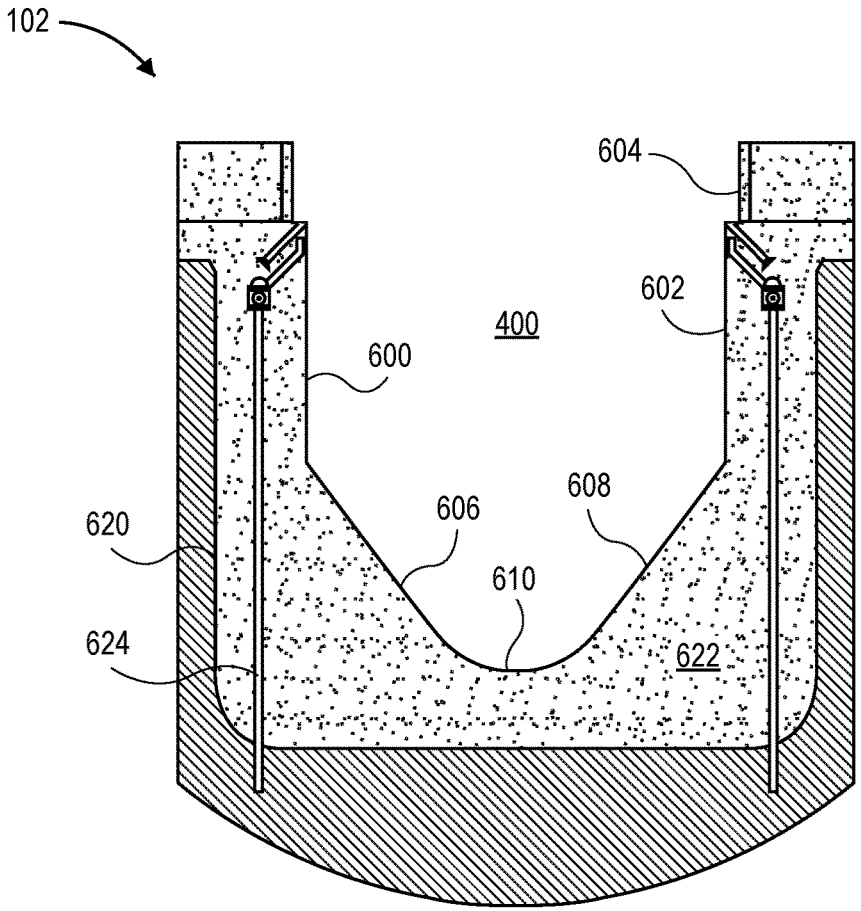
FIG. 6 illustrates a cross-sectional view of another embodiment of the trench, e.g., along line 6-6 of FIG. 4.

FIG. 6 illustrates a cross-sectional view of the main portion 400 of the trench 102, along line 6-6 of FIG. 4, according to an embodiment. The embodiment of FIG. 6 may represent an alternative to the embodiment of FIG. 5. In particular, the cross-sectional shape of the main portion 400 of the trench 102 may be different. As shown, the main portion 400 may include vertical sidewalls 600, 602, which extend generally straight downward from a grate-loading portion 604, where the grate 500 may be positioned. Angled sidewalls 606, 608 may extend at a non-zero, non-square (e.g., obtuse) angle to the vertical sidewalls 600, 602, respectively. The angled sidewalls 606, 608 may be connected together via a rounded (e.g., ovular or radiused) bottom surface 610. This cross-section may further enhance the aforementioned velocity gradient in the vertical cross-section of the flowpath, such that solids are prevented from being entrained near the bottom of the trench 102.

As also mentioned above, the trench 102 may be formed in concrete 620. The concrete 620 may be poured onto a generally square, rough trench 622 formed in compacted earth. The concrete 620 may be reinforced with steel rods 624 and/or the like.

Figure 7:
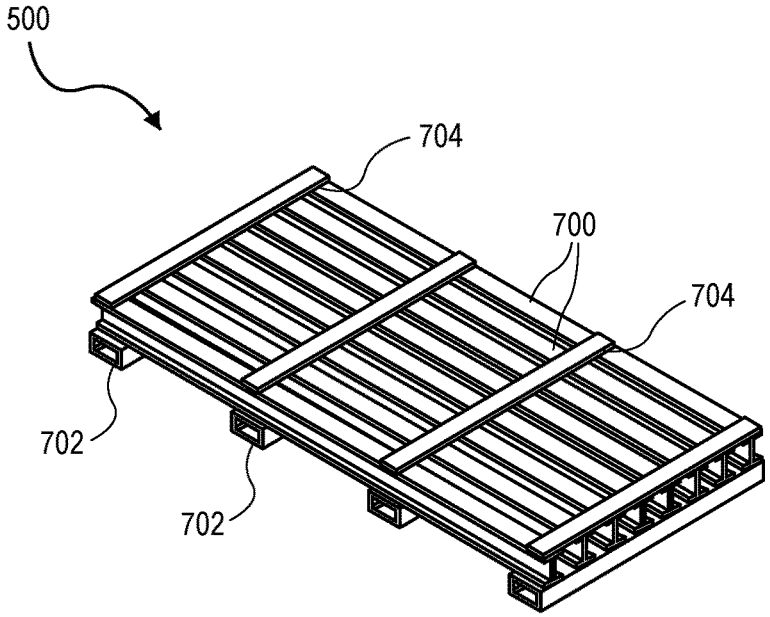
FIG. 7 illustrates a perspective view of a grate for the trench, according to an embodiment.

FIG. 7 illustrates a perspective view of the grate 500, according to an embodiment. The grate 500, as mentioned above, may be configured such that it is sufficiently robust to support the weight of trucks 104 driving over it and across the trench 102 (e.g., FIG. 1). In an embodiment, the grate 500 may include slats 700 that extend parallel to one another and are spaced apart sufficiently to allow solids to pass therethrough and into the trench 102. The slats 700 may be made from tube steel. The grate 500 may also include crossmembers 702, which may be positioned under the slats 700 (e.g., between the slats 700 and the trench 102 when in position on the trench 102). The crossmembers 702 may likewise be made from tube steel and may be spaced father apart from one another than are the slats 700. The grate 500 may also include linking members 704, which may be relatively thin strips of steel that connect the top of the slats 700 together. The linking members 704 may be aligned with the crossmembers 702.

Figure 8:
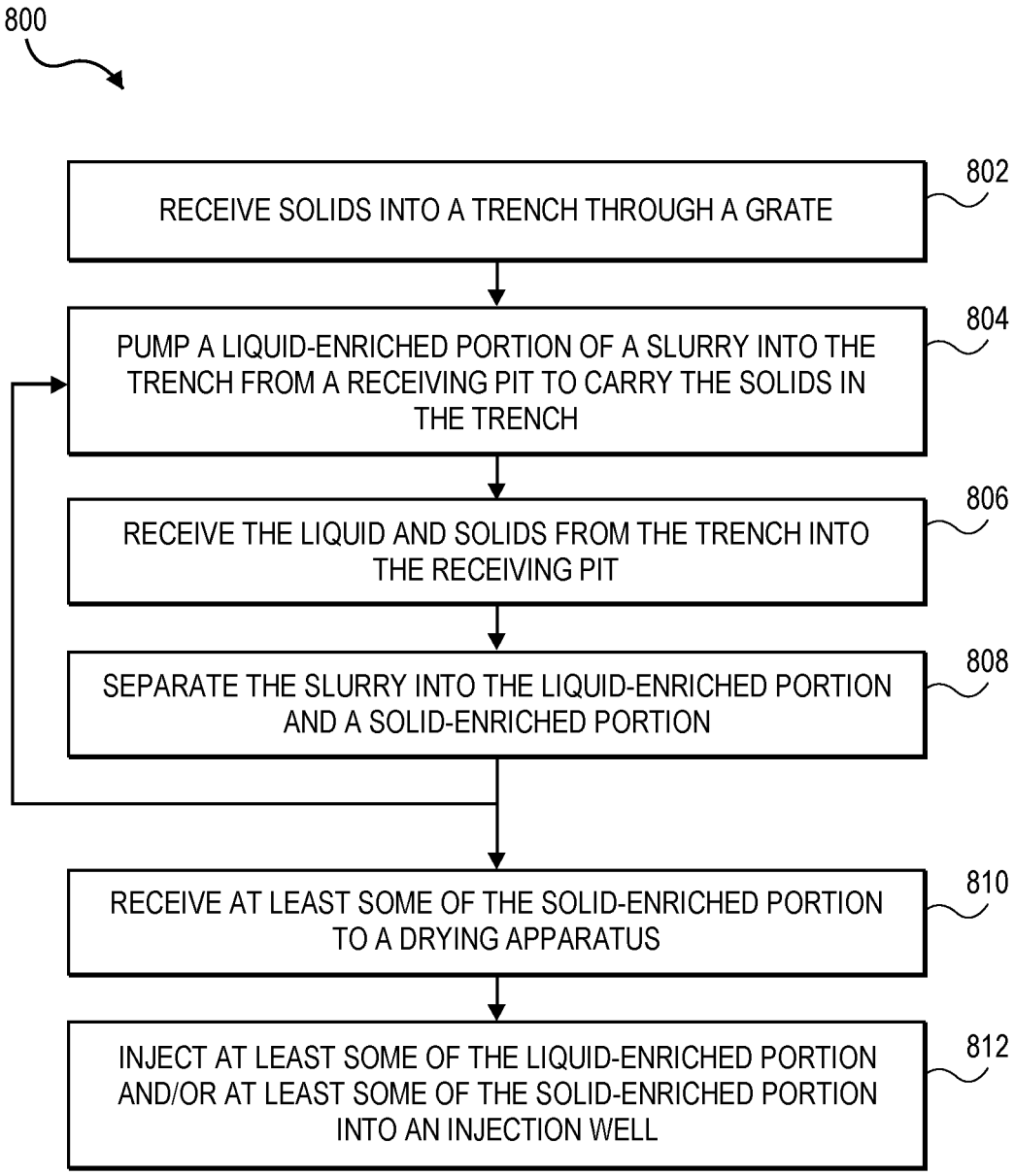
FIG. 8 illustrates a flowchart of a method for drilling fluid waste disposal, according to an embodiment.

FIG. 8 illustrates a flowchart of a method 800 for drilling fluid waste disposal, according to an embodiment. The method 800 is described herein with reference to the system 100 described above with reference to FIGS. 1-7 by way of example. The method 800 may include receiving solids through a grate 500 into a trench 102, as at 802. For example, the solids may be received into the loading portions 404-410 (FIG. 4) and may be motivated by gravity into the main portion 400.

The method 800 may include pumping a liquid-enriched portion of a slurry into the trench 102 to carry the solids through the main portion 400 and into a trench outlet 202, as at 804. The liquid-enriched portion may be pumped by a pump 112 in fluid communication with a receiving pit 106 at a first (or "fluid intake") position 206 of the receiving pit 106.

The method 800 may include receiving the liquid-enriched portion and the solids (e.g., as a slurry) from the trench outlet 202 into the receiving pit 106, as at 806. For example, the slurry may be received between a first weir 108A and a second weir 108B in the receiving pit 106. The weirs 108A-C may provide two paths for the slurry and may produce a tortuous path that promotes settling at least some of the solid out of suspension in the liquids.

For example, a solids-enriched portion (e.g., having a reduced concentration of liquids in comparison to the slurry that comes through the outlet 202) may be separated from the liquids-enriched portion (e.g., having a reduced concentration of solids in comparison to the slurry coming through the outlet 202) of the slurry, as at 808. For example, the receiving pit 106 may include the weirs 108A, 108B, and/or 108C, which may serve to at least partially separate liquids and solids in the receiving pit 106; however, other separating structures and/or devices are contemplated.

At least some of the solids-enriched portion may be received past the first weir 108A and provided to a drying apparatus (e.g., the drying slab 122), as at 810. The solids that are received into the drying slab 122 may be cleaned, ground, or otherwise further treated for disposal.

The liquids-enriched portion may be received past the second weir 108B, and not past the first weir 108A, and may be pumped back in the trench 102, as at 804, as the cycle repeats. The pump 112 may be used for such recycling of the slurry liquids. In an embodiment, the second weir 108B may be between the fluid intake position 206 of the pump 112 and the outlet 202 of the trench 102. Further, in a specific embodiment, the third weir 108C may be between the fluid intake position 206 and the second weir 108B. Liquids may be received past the third weir 108C after being received past the second weir 108B, such that at least some of the liquids that are drawn by the pump 112 are received past both the second and third weirs 108B, 108C and not the first weir 108A.

At least some of the liquids and/or solids that are received into the receiving pit 106 may eventually be injected into an injection well 140, as at 812. Such liquids that are injected into the injection well 140 may or may not have previously circulated through the trench 102. Further, the liquids that are provided to the injection well 140 may be further treated and/or mixed with other fluids, chemicals, etc. For example, the liquids may pass through shakers, mixers, oil separators, etc., prior to being injected into the injection well 140.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions of one component to another and are not intended to denote a specific spatial orientation (e.g., one component may be above another, despite the arrangement of the two components laid on its side). The terms "couple," "coupled," "connect," "connection," "connected," "in connection with," and "connecting" refer to "in direct connection with" or "in connection with via one or more intermediate elements or members." Further, "directly connected" means connected together with only components primarily configured for fastening/connecting therebetween.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A drilling fluid waste disposal system, comprising: a trench having an outlet; a receiving pit in fluid communication with the outlet of the trench; a first weir positioned in the receiving pit; a second weir positioned in the receiving pit, wherein the outlet of the trench is configured to feed a slurry comprising solids and a liquid to the receiving pit such that the slurry is separated into a liquid-enriched portion and a solids-enriched portion at least partially by the first and second weirs, wherein the outlet of the trench is positioned between the first and second weirs; a pump in communication with the receiving pit and the trench, wherein the pump is configured to draw the liquid-enriched portion of the slurry from a first position in the receiving pit, the second weir being between the first position and the outlet of the trench, and wherein the pump is configured to introduce at least some of the liquid-enriched portion of the slurry back into the trench; and a drying apparatus comprising a drying slab in communication with the receiving pit, wherein the drying apparatus is configured to receive the solids-enriched portion of the slurry from a second position in the receiving pit, wherein the first weir is between the second position and the outlet of the trench.

2. The system of claim 1, wherein the trench has a cross-sectional shape that is configured to produce a velocity gradient in slurry flowing in the trench, wherein a velocity of the slurry flowing in the trench increases toward a bottom of the trench.

3. The system of claim 1, wherein the trench has an oval or trapezoid shaped bottom and one or more loading portions configured to receive solid materials of the slurry therein, and channel the solid materials into a main portion of the trench.

4. The system of claim 1, wherein the trench comprises:

a vertical sidewall;

an angled sidewall extending downward and at an obtuse angle from the vertical sidewall; and a rounded bottom surface extending from the angled sidewall.

5. The system of claim 1, wherein the trench comprises:

a main portion that includes the outlet and is sloped downward as proceeding toward the outlet; and one or more loading portions that extend generally perpendicular to the main portion and are sloped downward toward the main portion.

6. The system of claim 1, further comprising a grate positioned over a top of the trench, wherein the grate comprises slats that are spaced apart to receive solids therethrough, wherein the grate is configured to be driven over by a truck that carries the solids.

7. The system of claim 1, further comprising a third weir, the second weir being positioned between the first and third weirs, and wherein the third weir is positioned between the outlet and the first position.

8. The system of claim 7, wherein the second weir comprises an outlet cutout, and wherein the third weir comprises an outlet cutout, the outlet cutout of the second weir being proximal to a first side of the receiving pit, and the outlet cutout of the third weir being proximal to a second side of the receiving pit, the first and second sides being opposite to one another.

9. The system of claim 8, wherein the first weir comprises an outlet cutout proximal to the second side of the receiving pit.

10. A method for drilling fluid waste disposal, comprising: receiving solids through a grate into a trench; pumping a liquid-enriched portion of a slurry into the trench to carry the solids in a slurry in the trench and through a trench outlet, the liquid-enriched portion being pumped by a pump in fluid communication with a receiving pit at a first position of the receiving pit; receiving the slurry from the trench outlet into the receiving pit; receiving a solids-enriched portion of the slurry past a first weir into a drying apparatus comprising a drying slab; and receiving at least some of the liquid-enriched portion of the slurry past a second weir, wherein the pump draws the at least some of the liquid-enriched portion that is received past the second weir, and wherein the trench outlet is between the first and second weirs.

11. The method of claim 10, further comprising receiving the at least some of the liquid-enriched portion past a third weir, wherein the at least some of the liquid-enriched portion that is drawn by the pump is received past both the second and third weirs but not the first weir.

12. The method of claim 11, wherein outlet cutouts of the second and third weirs are on opposite sides of the receiving pit.

13. The method of claim 10, wherein the trench has a cross-sectional shape that is configured to generate a velocity gradient in the slurry flowing in the trench, such that a velocity of the slurry in the trench increases proceeding toward a bottom of the trench.

14. The method of claim 10, wherein the trench has an oval or trapezoidal shaped bottom and the drying slab is generally L-shaped and attached to the receiving pit.

15. The method of claim 10, wherein the trench comprises:

a vertical sidewall;

an angled sidewall extending downward and at an obtuse angle from the vertical sidewall; and a rounded bottom surface extending from the angled sidewall.

16. The method of claim 10, wherein the trench comprises:

a main portion that includes the trench outlet and is sloped downward as proceeding toward the trench outlet; and one or more loading portions that extend generally perpendicular to the main portion and are sloped downward toward the main portion.

17. The method of claim 16, wherein the one or more loading portions are configured to receive the solids, the solids being carried at least partially by gravity into the main portion, and wherein pumping the liquid-enriched portion of the slurry comprises pumping the liquid-enriched portion of the slurry into the main portion of the trench.

18. The method of claim 10, further comprising separating the liquid-enriched portion from the solids-enriched portion in the receiving pit.

19. The method of claim 10, further comprising injecting at least a portion of the liquid-enriched portion from the receiving pit into an injection well.

20. A drilling fluid disposal system, comprising: a trench comprising a main portion having an outlet, wherein a cross-section of the main portion comprises vertical sidewalls, angled sidewalls each extending at an obtuse angle from a respective one of the vertical sidewalls, and a rounded bottom connecting the angled sidewalls; a receiving pit in fluid communication with the outlet of the trench; a first weir positioned in the receiving pit; a second weir positioned in the receiving pit, wherein the outlet of the trench is positioned between the first and second weirs, wherein the outlet of the trench is configured to feed a slurry comprising a solids portion and a liquid portion into the receiving pit between the first and second weirs; a first pump in communication with the receiving pit and the trench, wherein the first pump is configured to draw at least some of the liquid portion of the slurry from a first position in the receiving pit, the second weir being between the first position and the outlet of the trench, and wherein the first pump is configured to introduce the at least some of the liquid portion of the slurry back into the trench; a drying apparatus comprising a drying slab in communication with the receiving pit, wherein the drying apparatus is configured to receive at least some of the solids portion of the slurry from a second position in the receiving pit, wherein the first weir is between the second position and the outlet of the trench; and a second pump in communication with the receiving pit and an injection well, wherein the second pump is configured to draw at least some of the liquid portion of the slurry from the receiving pit, and wherein the at least some of the liquid portion of the slurry that is drawn by the second pump is injected into an injection well.

21. The system of claim 1, wherein the first weir is configured to permit more of the solids-enriched portion than the liquids-enriched portion to flow past the first weir, and wherein the solids-enriched portion comprises a higher solids content than the slurry in the trench.

22. The system of claim 21, wherein second weir is configured to permit more of the liquid-enriched portion than the solids-enriched portion to flow past the second weir, and wherein the liquid-enriched portion comprises a higher liquid content than the slurry in the trench.

23. The system of claim 1, further comprising: one or more tanks configured to receive and filter water to produce filtered water; and a second pump configured to cause at least some of the liquid-enriched portion and a first portion of the filtered water to flow into a well.

24. The system of claim 23, wherein a second portion of the filtered water is transferred to the trench.

25. The system of claim 1, wherein at least a portion of the solids-enriched portion is transferred from the drying slab into the receiving pit.

26. The system of claim 25, further comprising a chute configured to receive additional slurry from a truck, wherein the additional slurry flows into the receiving pit.

* * * * *